United States Patent [19]

Micheau

[11] Patent Number: 5,040,374

[45] Date of Patent: Aug. 20, 1991

[54] PROCESS AND DEVICE FOR REGULATING A FLOW OF LIQUID $CO_2$, AND APPLICATION THEREOF IN A COOLING TUNNEL

[75] Inventor: Patrick Micheau, Bievres, France

[73] Assignee: L'air Liquide, Societe Anonyme Pour L'etude Et L'Exploitation Des Procedes Georges Claude, Paris, France

[21] Appl. No.: 456,868

[22] Filed: Dec. 27, 1989

[30] Foreign Application Priority Data

Dec. 28, 1988 [FR] France ..... 88 17305

[51] Int. Cl.[5] ..... F17C 7/02

[52] U.S. Cl. ..... 62/52.1; 62/384; 62/374; 62/380

[58] Field of Search ..... 62/384, 52.1, 374, 380

[56] References Cited

U.S. PATENT DOCUMENTS

| | | | |
|---|---|---|---|
| 3,109,296 | 11/1963 | Williamson et al. | 62/52.1 |
| 3,214,928 | 11/1965 | Oberdorfer | 62/384 |
| 3,661,483 | 5/1972 | Bose | 62/384 |
| 3,708,995 | 1/1973 | Berg | 62/374 |

FOREIGN PATENT DOCUMENTS

| | | |
|---|---|---|
| 2142309 | 1/1973 | France . |
| 2368665 | 5/1978 | France . |
| 807088 | 1/1959 | United Kingdom . |
| 351839 | 7/1981 | United Kingdom . |

*Primary Examiner*—Ronald C. Capossela

*Attorney, Agent, or Firm*—Young & Thompson

[57] ABSTRACT

According to the process, there is maintained in a conduit (3), on the downstream side of a valve (5), up to the vicinity of the point A of injection of the $CO_2$, an intermediate pressure (PI) higher than the pressure (PT) of the triple point of the $CO_2$. Application in the treatment of waste waters or the deep freezing of food.

10 Claims, 2 Drawing Sheets

PROCESS AND DEVICE FOR REGULATING A FLOW OF LIQUID $CO_2$, AND APPLICATION THEREOF IN A COOLING TUNNEL

The present invention relates to a process and device for regulating a flow of liquid $CO_2$ in a thermally-insulated conduit provided with a valve controlled in a continuous manner.

$CO_2$ (carbon dioxide) is employed for many processes in the industrial field (for example: carbonatation in chemistry, neutralization of basic agents and adjustment of pH in the treatment of water), and in the agricultural food field (for example: rapid cooling and deep freezing, control of temperature).

In these applications, bearing in mind the needs, the $CO_2$ is most often delivered in the liquefied form and stored in this form in a reservoir.

The characteristics of the processes require the possibility of adapting the flow of $CO_2$ to the charge to be treated; thus it is necessary to regulate the flow of $CO_2$ as a function of parameters characteristic of the process: measurement of the pH in the treatment of water, measurement of the temperature in cryogenic treatments.

The regulating method which is theoretically the most precise and the cheapest as concerns the consumption of $CO_2$ is that consisting in continuously regulating the flow of liquid $CO_2$ by means of a controlled valve having a variable opening controlled by a regulator having a derived, integral and proportional action. The principle of such a valve is to present a restriction to the flow of the liquid. The section of this restriction is adjusted by means of a closure member which moves in a continuous manner between two end positions under the effect of electric or pneumatic power.

The $CO_2$ arrives on the upstream side of this valve at a pressure close to that of the reservoir, namely 11 to 60 bars as the case may be. The restriction of the section results, according to the laws of flow of fluids, in a loss of pressure which increases with decrease in the section of the passage defined by the closure member. When temporarily the operation of the process is such that the need of $CO_2$ is minimum, the valve takes up a position close to its complete closure. The restriction of the section is then maximum and the pressure drop across the valve is sufficiently large to ensure that the pressure of the $CO_2$ on the downstream side of the valve assumes values lower than 5.2 bars.

This value of 5.2 bars corresponds to the pressure of the triple point of $CO_2$ which is a value within which the liquid CO is instantaneously converted into a mixture of gaseous $CO_2$ and solid $CO_2$ (carbon dioxide snow).

Now, the constructional characteristics of regulating valves employed for these processes are such that the small diameter and the tortuous shape of the piping immediately on the downstream side of the closure member result in an immediate clogging as soon as the carbon dioxide snow appears.

Consequently, in practice, these regulating valves are only rarely of utility for the regulation of a flow of liquid $CO_2$, and the solutions usually adopted employ other techniques: the rather imprecise open-closed regulation or, when the application does not require liquid $CO_2$, the use of a vaporizer on the upstream side of the regulating valve, which is an expensive technique as concerns investment and power expenditure.

An object of the invention is to permit the use of a valve which is controlled in a continuous manner in all cases.

The invention therefore provides a process comprising maintaining in the conduit, on the downstream side of the valve up to the vicinity of the point of injection of the $CO_2$, an intermediate pressure higher than the pressure of the triple point of the $CO_2$.

Preferably, before connecting the conduit to the reservoir of liquid $CO_2$, there is injected into this conduit, on the upstream and downstream sides of the valve, gaseous $CO_2$ at a pressure between said pressure of the triple point and said intermediate pressure.

The invention also provides a device for carrying out said process. In this device, the conduit comprises, on the downstream side of the valve, a conduit section leading to a discharger.

According to advantageous features:

- the discharger (4) comprises an outlet orifice on the axis of its closure member;
- a pipe having substantially the same diameter as the outlet orifice of the discharger extends from this orifice to the point of injection of the $CO_2$ The invention also provides a cooling tunnel comprising a plurality of points of injection of $CO_2$ and a device such as that defined hereinbefore in which said conduit section includes a plurality of branches each leading to a discharger, each discharger being disposed at one of said points of injection. The dischargers may be adjusted at different opening pressures.

Some embodiments of the invention will now be described with reference to the accompanying drawings, in which.

Figure 1:
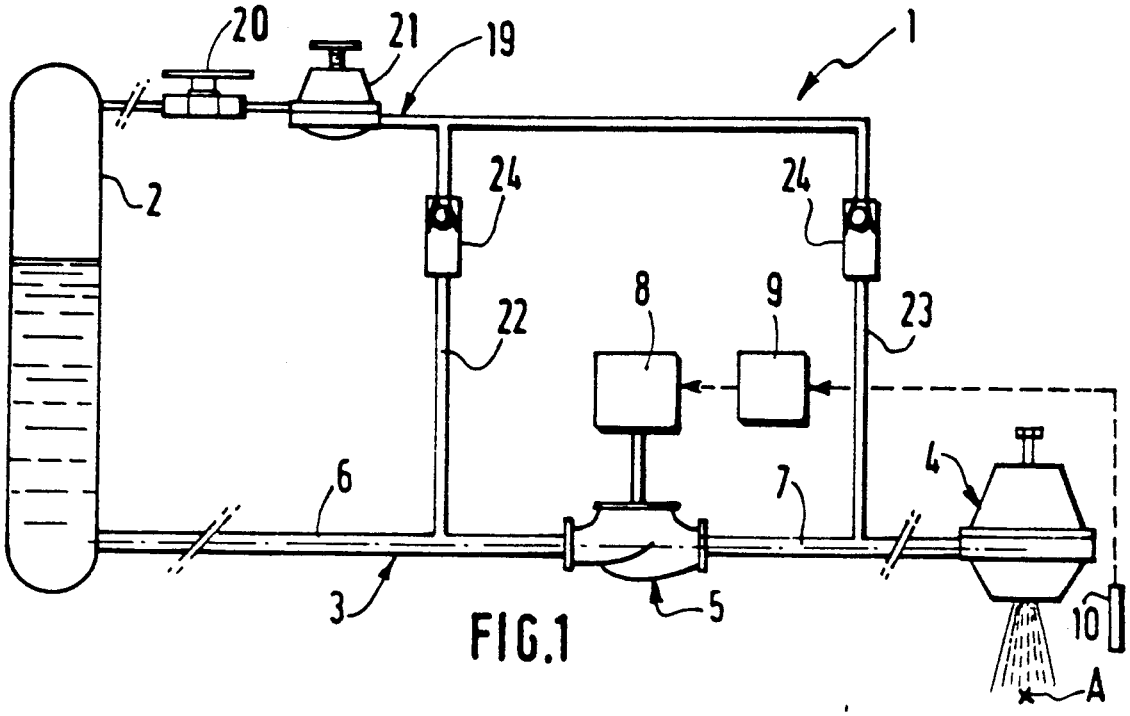
FIG. 1 is a diagrammatic view of a device according to the invention.

The regulating device shown in FIG. 1 is adapted to deliver a variable flow of $CO_2$ at an injection point A from a storage reservoir 2 in which there is maintained a pressure PS which is distinctly higher than the pressure PT of the triple point of the $CO_2$ (5.2 bars), and generally between 11 and 60 bars. The point A is at a given pressure PO, for example substantially equal to atmospheric pressure, but in any case lower than PT.

The regulating device 1 comprises a thermally-insulated liquid conduit 3 leading from the lower part of the reservoir 2 to a discharger 4. A controlled valve 5 is inserted in this conduit and defines in the latter an upstream section 6, from the reservoir to the valve, and a downstream section 7, from the valve to the discharger. This valve comprises a closure member whose position may vary in a continuous manner between a position of maximum opening and a position of total closure of the valve, by the action of a motor 8. The latter is controlled by a control 9 which receives from a measuring instrument 10 (for example a pH meter or a thermometer) a signal which represents the control magnitude.

Figure 2:
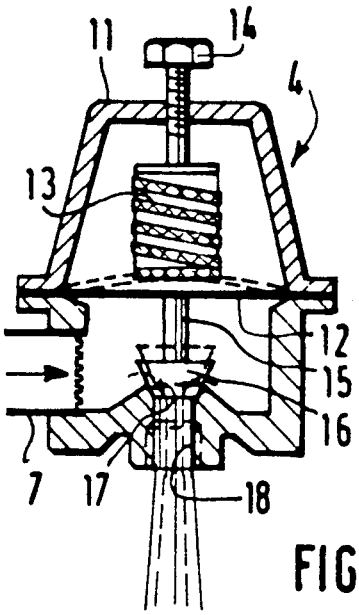
FIG. 2 is a longitudinal sectional view of the discharger of this device.

The discharger 4 (FIG. 2) comprises a housing 11 divided into two chambers by a membrane 12. A coil spring 13, whose force is adjustable by means of a screw 14, is disposed in one of these chambers, while the other chamber (the lower chamber as viewed in FIG. 2) receives the fluid contained in the conduit section 7. In this other chamber, a closure member rod 15 is connected to the membrane and terminates in a closure member 16 cooperative with a seat 17 located at the entrance of the outlet orifice 18 of the discharger. The elements 13 to 18 are all coaxial.

Consequently, the closure member 16 is lifted from its seat if, and only if, the pressure prevailing in the lower chamber of the discharger exceeds the pressure corresponding to the force of the spring 13. It is therefore possible to adjust the screw 14 in such manner that this opening occurs when the pressure in the section 7 is at least equal to an intermediate pressure PI higher than the pressure PT.

A gaseous $CO_2$ conduit 19 leads from the upper part of the reservoir 2 and includes, from the upstream end to the downstream end, a stop valve 20 and a pressure reducing valve 21. The latter delivers on the downstream side a pressure P2 higher than PT but lower than PI. On the downstream side of the pressure reducer 21, the conduit 19 is divided into two branches 22 and 23 which respectively lead to the sections 6 and 7 respectively of the conduit 3. Each branch is provided with a check-valve 24 which allows the flow of fluid only in the direction from the pressure reducer 21 to the conduit 3.

In operation, the device is first of all set at pressure P2 by opening the valve 20. In this way, it is guaranteed that the pressure will not drop below the triple point of the $CO_2$ at any point of the device.

Then, by means of an initiating control (not shown), the liquid $CO_2$ is admitted into the conduit 3. The discharger 4 is opened when the pressure in the section 7 is higher than the value PI and a jet of carbon dioxide snow then issues from the orifice 18. The discharge of this snow occurs with no hindrance owing to the location of the orifice 18 on the axis of the membrane-closure member system.

In a variant (FIG. 3), in the case where the carbon dioxide snow needs to be conducted in a short portion of the piping before reaching the injection point A, there is connected to the orifice 18 a pipe 25 which has no internal asperity or pronounced bend. The inside diameter of the pipe 25 is throughout its length substantially equal to the inside diameter of the orifice 18 and offers no restriction of section to the flow of the gas-solid mixture.

Figure 3:
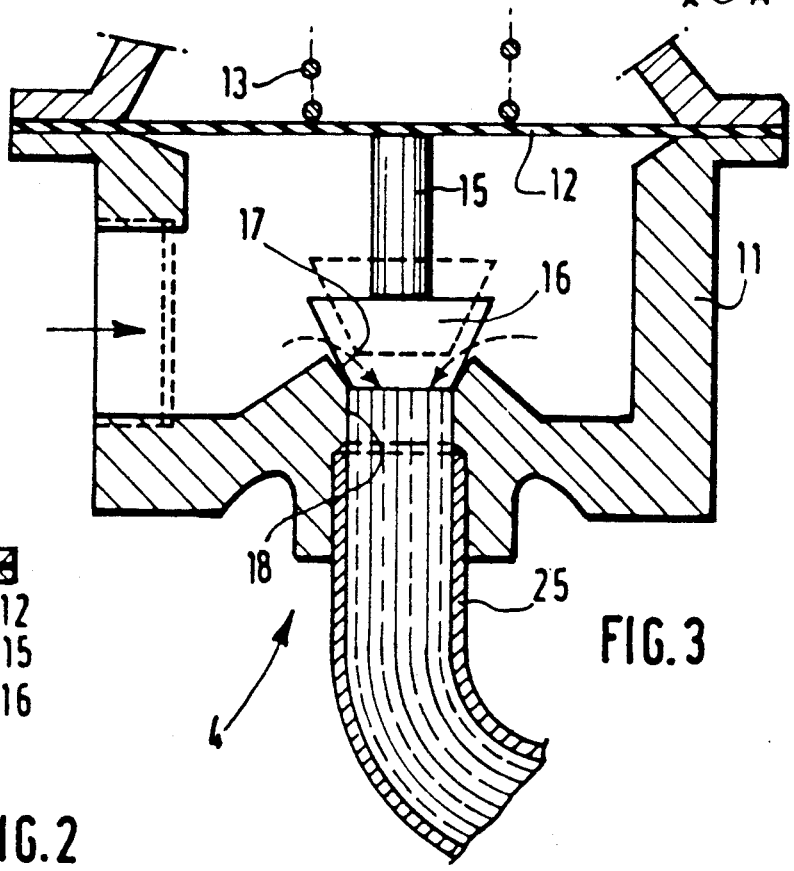
FIG. 3 is a partial longitudinal sectional view, to an enlarged scale, of a variant of this discharger.
Figure 4:
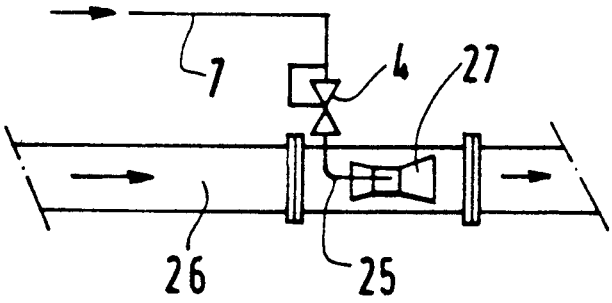
FIGS. 4 and 5 are diagrammatic illustrations of the applications of the process according to the invention.

An application of the variant shown in FIG. 3 is diagrammatically illustrated in FIG. 4. It concerns the regulation, by means of a measurement of the pH, of a flow of liquid $CO_2$ injected into in a waste water duct 26 so as to neutralize a basic effluent therein.

The pipe 25 opens into a venturi 27 adapted to inject and spray the carbon dioxide snow into the stream of water.

Figure 5:
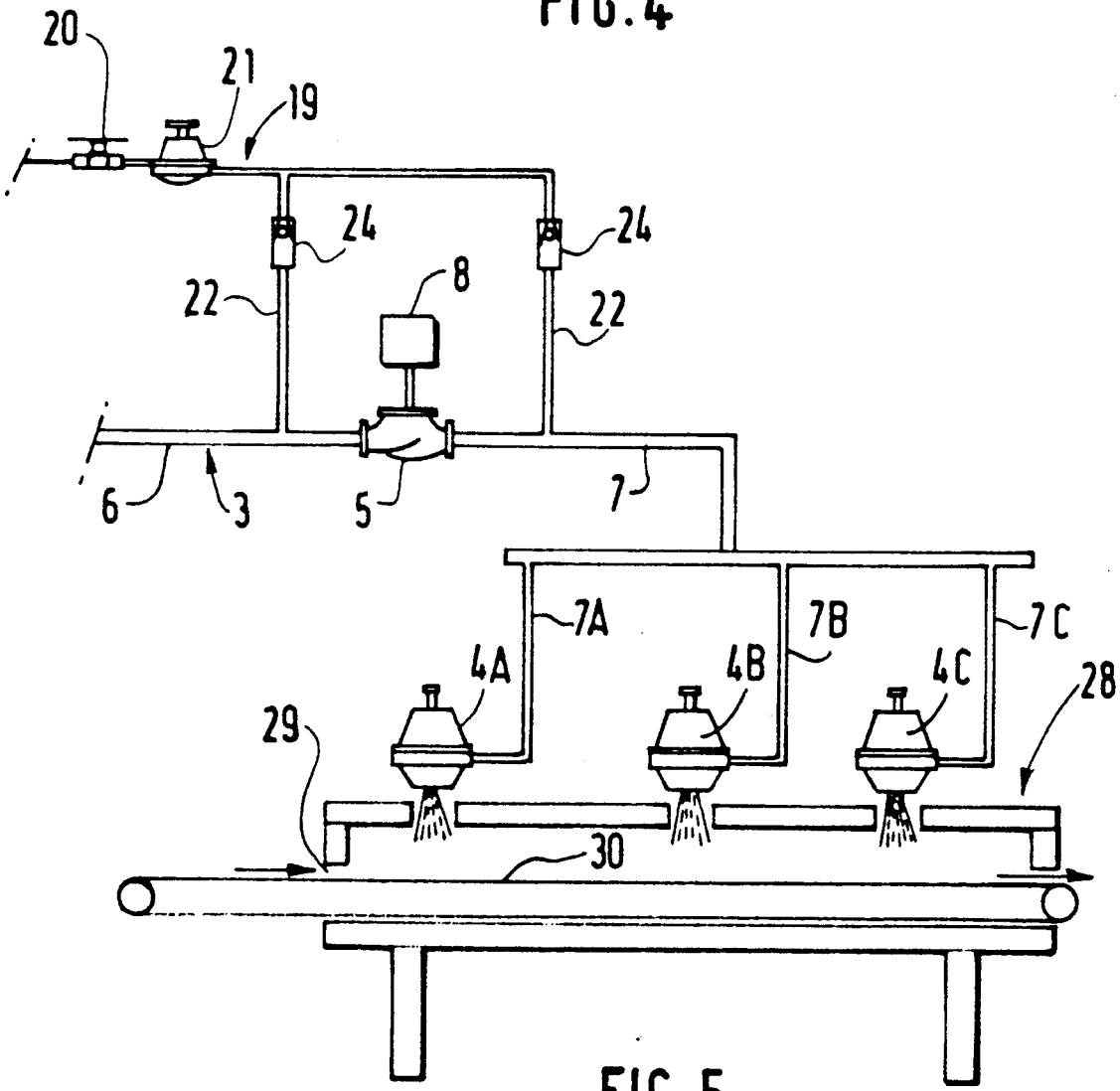

FIG. 5 shows a variant of the device of FIG. 1 in which the conduit section 7 is divided into three branches 7A to 7C each leading to a respective discharger 4A to 4C. This permits delivering the $CO_2$ at a plurality of injection points and, by adopting different pressure settings for each discharger, injecting individually adjustable flows of $CO_2$ for each injection point.

This possibility is of particular interest for, for example, producing more or less cold regions in a longitudinal tunnel for deep freezing food products, as illustrated in FIG. 5.

In this application, the valve 5 is regulated by means of a single measurement of temperature taken close to the outlet of the tunnel. The $CO_2$ is injected in parallel through the dischargers 4A to 4C so as to distribute the freezing product throughout the length of the tunnel 28. In a permanent operation mode, the discharger 4A located adjacent to the entry 29 of the products to be treated, fed by a conveyor belt 30, produces a flow of $CO_2$ larger than the others owing to its adjustment at a lower pressure PI−A. Further, when the installation operates at close to its minimum output (standby position between two treating stages), this first discharger could be the sole discharger to operate.

The arrangement shown in FIG. 5 permits obtaining in a simple and cheap manner a reliable and precise regulation of the deep freezing procedure.

The invention finds application in many other processes consuming $CO_2$. It is particularly well adapted in applications requiring a considerable flow of $CO_2$ (at least 100 kg/h), delivered in a quasi-continuous manner and at a rate which is variable in a ratio of about 1 to 5.

I claim:

1. Process for regulating a flow of liquid $CO_2$ in a thermally-insulated first conduit provided with a regulating valve, there being a point of discharge of said $CO_2$ from said first conduit downstream from said regulating valve, said process comprising maintaining in a permanent manner throughout the flow in the first conduit, on the downstream side of the valve, up to the vicinity of said point of discharge of the $CO_2$, an intermediate pressure which is higher than the pressure of the triple point of the $CO_2$, the maintaining of said intermediate pressure being effected by the delivery of $CO_2$ to said first conduit via second conduit means communicating with said first conduit and having a check-valve that prevents flow of fluid in a direction away from said first conduit.

2. Process according to claim 1, comprising injecting, before connecting the first conduit to a reservoir of liquid $CO_2$, into said first conduit, on the downstream side of the valve, gaseous $CO_2$ at a pressure between said pressure of the triple point and said intermediate pressure, via said second conduit, said process further comprising injecting into said first conduit, via said second conduit, gaseous $CO_2$ at said pressure between said pressure of the triple point and said intermediate pressure, on the upstream side of the valve.

3. Process according to claim 1, comprising delivering the flow of liquid $CO_2$ by means of a discharger.

4. Process according to claim 1, wherein said second conduit means communicates with said first conduit between said regulating valve and said point of discharge.

5. Process according to claim 1, wherein said second conduit means communicates with said first conduit both upstream and downstream of said regulating valve.

6. Process according to claim 1, wherein said $CO_2$ in said second conduit means is drawn from a supply of gaseous $CO_2$ which forms an atmosphere above a body of liquid $CO_2$ from which said liquid $CO_2$ is drawn.

7. A device for regulating a flow of liquid $CO_2$, comprising a reservoir of $CO_2$ under pressure, a first conduit connected to the reservoir for drawing off liquid $CO_2$, a regulating valve inserted in said first conduit, a second conduit connected to the reservoir for drawing off gaseous $CO_2$, a pressure reducer and a check-valve inserted in said second conduit, said second conduit being connected to said first conduit in a section of said first conduit on the downstream side of the regulating valve, a discharger connected to an end of said first conduit, the discharger comprising a membrane, a valve closure member carried by the membrane, an ejection valve seat with which seat said closure member is cooperative, said valve seat constituting an outlet of the discharger, and a spring having an adjustable effect biasing said membrane to a position for applying the closure member against said seat.

8. Device according to claim 7, further comprising a third conduit, a second check-valve inserted in said third conduit, said third conduit connecting said second conduit to said first conduit on the upstream side of the regulating valve.

9. Device according to claim 7, wherein said valve seat defines an outlet of the discharger and a pipe having substantially the same inside diameter as the outlet of the discharger extends from said outlet to a point of injection of the $CO_2$.

10. Device according to claim 7, wherein said section comprises a plurality of branches each leading to a respective discharger, comprising a reservoir of liquid $CO_2$ under pressure, a distributing conduit having a regulating valve, putting said conduit under gaseous pressure.

* * * * *